US006862958B2

(12) United States Patent
Schade

(10) Patent No.: US 6,862,958 B2
(45) Date of Patent: Mar. 8, 2005

(54) FLEXIBLE DRIVE SHAFT

(76) Inventor: Robert L. Schade, 553 Babb Ave., Reedsburg, WI (US) 53959

( * ) Notice: Subject to any disclaimer, the term of this patent is extended or adjusted under 35 U.S.C. 154(b) by 0 days.

(21) Appl. No.: 10/331,042

(22) Filed: Dec. 28, 2002

(65) Prior Publication Data

US 2003/0131693 A1 Jul. 17, 2003

Related U.S. Application Data

(63) Continuation of application No. 09/844,323, filed on Apr. 30, 2001, now abandoned.

(51) Int. Cl.[7] ..... B25B 23/16

(52) U.S. Cl. ..... 81/177.6; 464/153; 464/169; 408/127; 403/223

(58) Field of Search ..... 81/177.6; 403/223; 408/127; 464/147, 150–153, 155, 161, 169, 119

(56) References Cited

U.S. PATENT DOCUMENTS 1,315,806 A * 9/1919 Wilson ..... 464/153
3,585,885 A * 6/1971 Carr ..... 81/177.6
4,362,520 A * 12/1982 Perry ..... 464/149
4,730,960 A * 3/1988 Lewis et al. ..... 81/177.6

* cited by examiner

*Primary Examiner*—Debra S. Meislin
(74) *Attorney, Agent, or Firm*—Craig A. Fieschko, Esq.; DeWitt Ross & Stevens S.C.

(57) ABSTRACT

A flexible drive shaft extension for hand tools comprises serially nested, socket-ended Shaft components of polygonal cross-section which have freedom of universal motion from axial alignment limited to about five degrees of arc and which are forcibly retained in coupled connection within a sleeve by spring biasing.

40 Claims, 2 Drawing Sheets

FLEXIBLE DRIVE SHAFT

This application is a continuation of U.S. patent application Ser. No. 09/844,323 filed 30 Apr. 2001, now abandoned.

FIELD OF THE INVENTION

A drive shaft imparts torque from a power source to machinery.

BACKGROUND OF THE INVENTION

Flexible drive shafts are provided for utilizion with portable tools in spacially restricted locations which do not allow for use of one's hands or placement of a power source in a manner required for conventional operation of the tool.

SUMMARY OF THE INVENTION

Universal joints in serially connected assembly are known for use as articulated drive shafts for portable tools. Such assemblies are limited in utility by the strength of an enveloping sleeve to restrict articulation of the joints to a degree less than that which causes the sleeve to crimp or twist into helical contortion in response to torque applied to the the shaft.

The drive shaft of this invention provides a flexible elongated sleeve housing containing spring loaded, unconnected, abutting torque transmission elements. The configuration of each element provides for limited freedom of universal movement from axial alignment to occur between between conjoined elements. Preferably, such movement is limited to about five degrees of diviation from axial alignment, not to exceed about ten degrees. Such construction improves torque transmitting capacity of a drive shaft with lesser complexity than prior art means utilizing pinned or or interlocking connection between elements.

DESCRIPTION OF THE INVENTION

Figure 1:
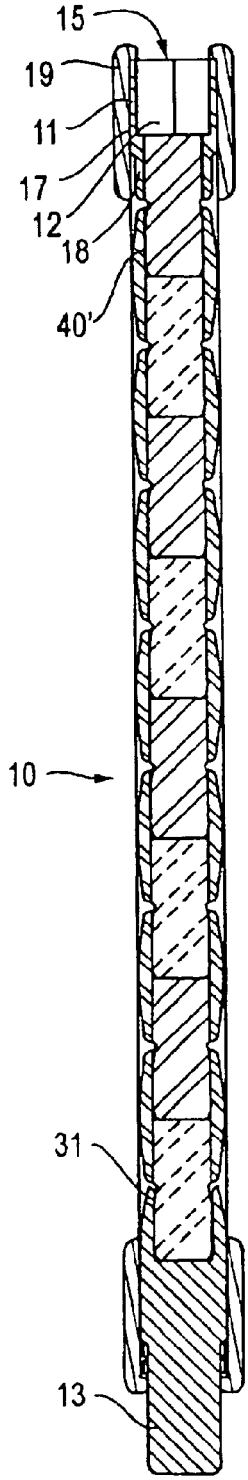
FIG. 1 is a cross-sectional elevation of a preferred embodiment of a flexsible drive shaft this invention shown in axially straight disposition.

FIG. 1 depicts drive shaft 10 for use with, for example, hand tools such as manually operated ratchet drivers or compressed air driven impact tools. The drive shaft is usable with a wide range of other tools and machinery.

Driven element 11 at a first end of drive shaft 10 is operably connectable to a prime mover, not shown, by square distal end socket portion 12 of element 11 being, preferably, of standard face width dimension for such use, e.g. in the English system of measurement, ¼ inch, ⅜ inch, ½ inch, etc. for operably receiving a square shaft end of complementary size.

The remainder of driven element 11 comprises proximal end socket portion 18. The inner cross-sectional socket configuration may be any suitable polygonal cross-section, but preferably is hexagonal. The outer surface cross-sectional configuration is preferably round. Proximal end socket portion 18 is configured with inner and outer peripheral diameters reduced in size from those of distal end socket portion 12.

End cap 17 extends axially beyond distal end socket portion 12 with flange portion 19 thereof projecting radially inward to provide a bearing surface for slidable rotational contact with the face of distal end socket portion 12. Central opening 15 in end cap 17 enables endmost accessibilty into drive shaft 10 to be made by a shaft end of a prime mover or other power source.

At the opposite end of drive shaft 10, driver end element 13 is configured with cross-sectionally square distal end stud portion 14, which is complementary in size to distal end socket portion 12 of element 11. Any other operable configuration of end elements 11 and 13 may be utlized to accomodate other connecting means.

Figure 3:
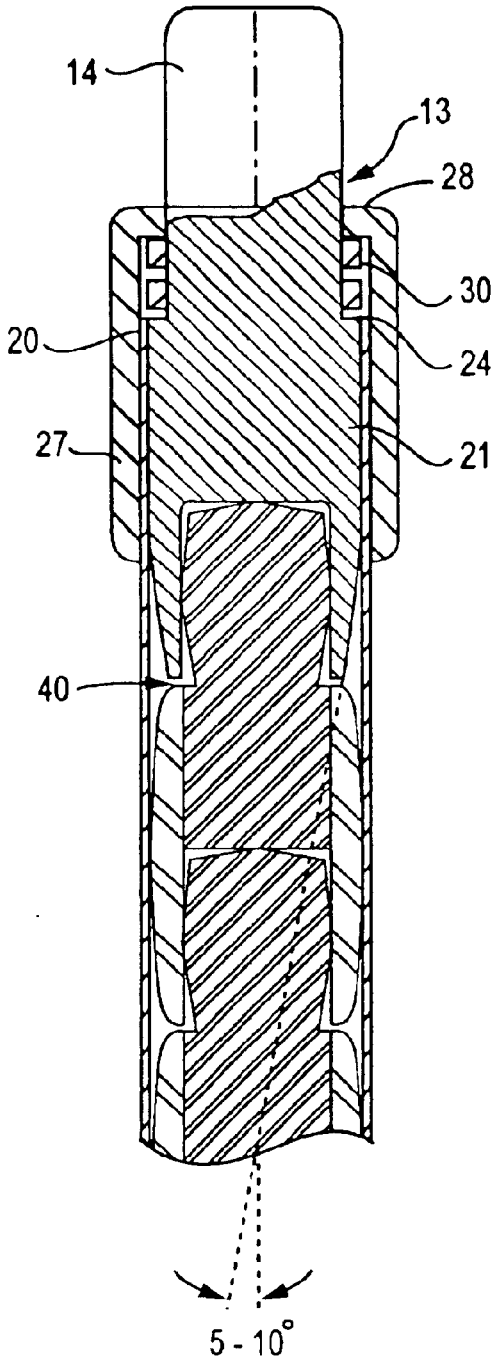
FIG. 3 is an enlarged view of one end portion of the drive shaft of FIGS. 1 and 2.

Proximal end portion 21 of driver end element 13 is preferably cross-sectionally round. In FIGS. 1 and 3, shoulder portion 24 of element 13 provides a stepped increase in the outer diameter of element 13 from which the surface assumes a truncated ellipsoidal form which decreases in diameter approximately ellipsoidally toward the proximal end face of element 13 with a tangent angle between the outer surface of element 13 at the proximal end to the longitudinal axis of element 13 being preferably about five degrees and not more than about ten degrees. Socket 31, which may be of any suitable polygonal cross-section, but preferably is hexagonal, opens to the proximal end of element 13, extending axially longitudinal in element 13.

End cap 27 is configured with radially inward extending, distal end face flange portion 28 disposed in sliding contact with the peripheral face of distal end portion 21 of element 13. End caps 17 and 27 retain assembly of drive shaft 10 intact.

Helical compression spring 30 is disposed peripherally around proximal end portion 21 of driver element 13 between shoulder 24 of element 13 and flange portion 28 of end cap 27.

Flexible sleeve 20 is fixedly secured to the inner peripheral surfaces of end caps 17 and 27. It is kept tautly drawn by tensioning action of spring 30 acting through tightly coupled nesting components of drive shaft 10 disposed intermediate the two ends of the shaft. Spring 30 forcibly bears on shoulder 24 of element 13 and flange portion. 28 of end cap 27, and resiliently adjusts by operably expanding or contracting in response to curvilinear flexing of drive shaft 10 during use.

Figure 2:
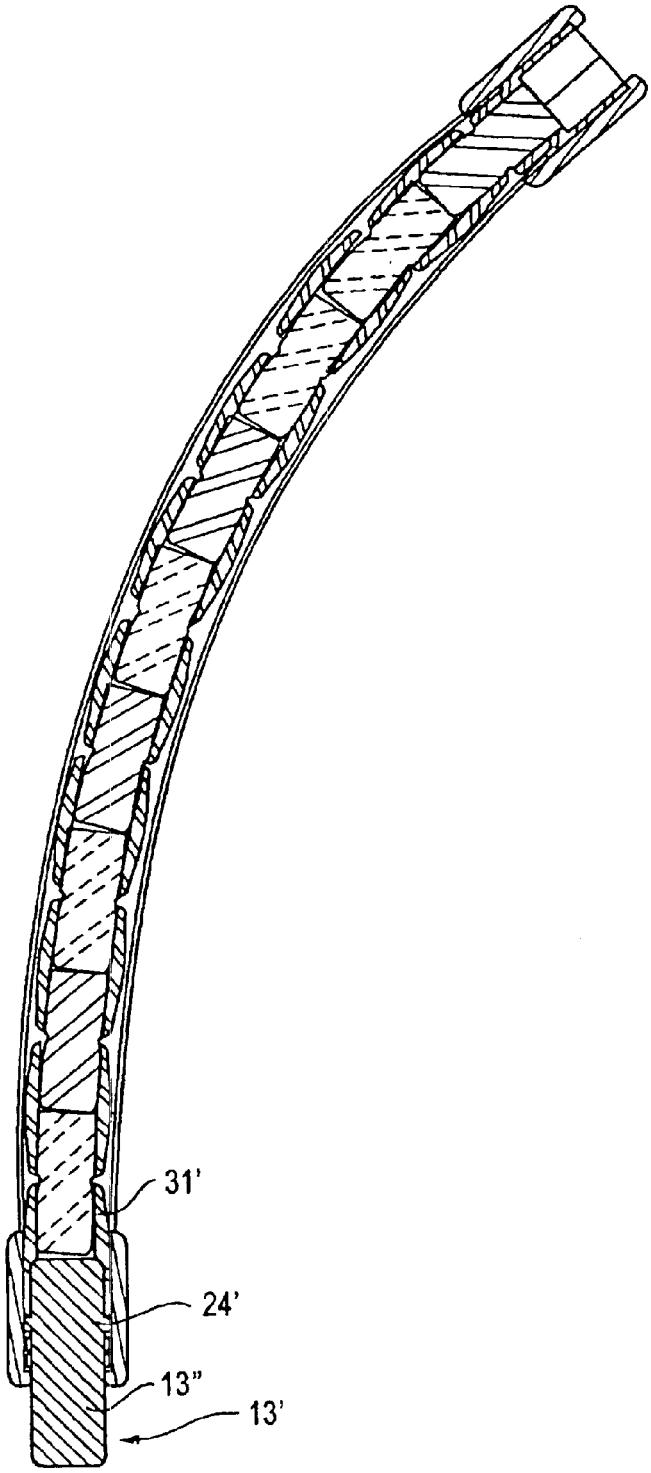
FIG. 2 is a cross-sectional elevation of the apparatus of FIG. 1 shown in curvilinear axial disposition.

In the embodiment of invention of FIG. 2, driver end element 13' differs from similar element 13 of FIGS. 1 and 3 by comprising two components, i.e. core piece 13" and socket piece 31'. The two latter components are unitarily affixed to provide the same configuration as element 13 of FIGS. 1 and 3, but allows for alternative ways of manufacturing components, whether by forging, casting, machining, press fitting or other known processes. In FIG. 2 shoulder 24' is configured as an integral band configured portion which increases the outer diameter of core piece 13" for a short axial distance rather than providing a step in the configuration of the whole outer diameter as in the case of shoulder 24 of FIGS. 1 and 3. Correspondingly, socket piece 31' of FIG. 2 while being a separate part is unitarily affixed to core piece 13" to provide a resulting structure similar to element 13 of FIGS. 1 and 3.

Seven identical core elements 40 together with one non-identical core element 40' comprise the remainder of components of drive shaft 10 shown in the FIGS. 1, 2, and 3.

Figure 4:
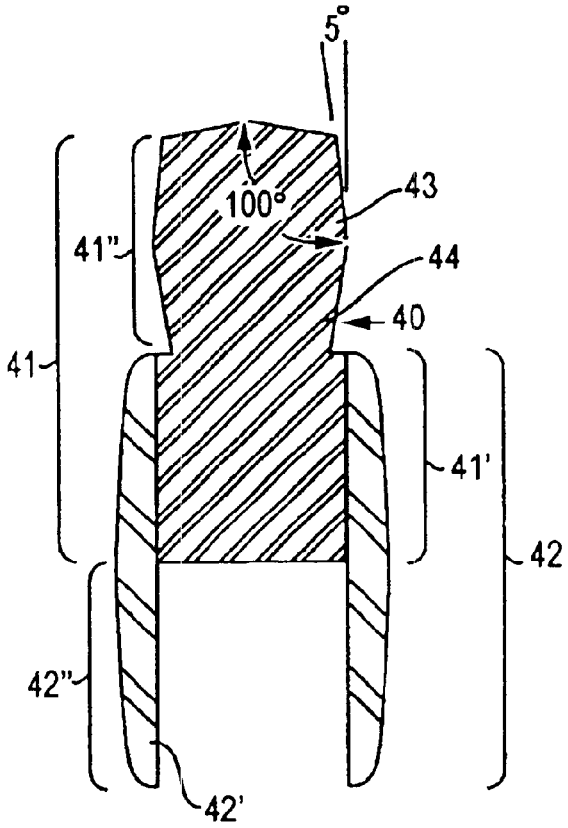
FIG. 4 is an isolated view of element 40 of FIG. 1.

They are shown each to be of two-piece construction, and in all material ways are subject to similar choice of construction practice as shown for elements 13 and 13' so as to be constructed either from one piece or from two pieces which are subsequently unitarily connected. Each core element 40 comprises unitary shank portion 41 and socket portion 42. Shank portion 41 (FIG. 4) is disposed with jacketed end portion 41' encased unitarily in the base end of socket portion 42 and can either be of polygonal or circular cross-sectional interface configuration, or of other operable mating configuration as desired. Nesting end portion 41" of shank portion 41, integral with end portion 41', is configured with a polygonal cross-section, which may be of any operable shape, but preferably is regular hexagonal. From approximately the longitudinal axial mid-point of nesting end portion 41" toward each axial end extremity of portion 41" the planar faces of the peripheral polygonal surface of end portion 41' each make an angle of preferably about five degrees with the longitudinal axis of core element 40 whereby end portion 41" is of lesser diameter at each end than at the middle. The end portion 41" can thus be considered to include a shank portion head 43 spaced distally from the end portion 41' and the socket portion 42, and a shank portion juncture 44 extending between the shank portion head 43 and the socket portion 42/end portion 41', wherein the shank portion juncture 44 narrows in diameter between the shank portion head 43 and socket portion 42/end portion 41', with the shank portion head 43 then defining a member of greater diameter before it begins narrowing in diameter as it extends further from the socket portion 42, end portion 41', and shank portion juncture 44. In addition, it is preferred as shown in the drawings, but not required, that the end face of end portion 41" be configured with planar segments disposed at an angle of approximately one hundred degrees to associated planar peripheral faces of portion 41". The resulting configuration is one of providing a faceted protruding conical end to end portion 41".

Socket portion 42 of core element 40 is in all material respects similar to socket piece 31' of FIG. 2 with the exception that the inner peripheral face portion 42' encasing peripheral portion 41" is of uniform diameter rather than being of stepped diameter as it is for socket piece 31'. Instead of being affixed to core piece 13' as in FIG. 2, socket portion 42' is affixed to base portion 41' of shank portion 41 to provide unitary core element 40. The outer peripheral surface of socket portion 42 is of circular cross-section and of ellipsoidal axially longitudinal section. The inner peripheral surface of annular socket portion 42" is of polygonal cross-section with regular hexagonal cross-sectional configuration being preferred. Socket portion 42" inner diameter is such as to be complementary for operable receiving nesting end portion 41" of shank portion 41 of a next adjacent core element 40. The depth of socket portion 42 is such that nesting end portion 41" disposed within a socket will contact the bottom of the socket, i.e. the end face of base portion 41' of element 40 with which it is nested, while the endmost extremities of socket portions 41' of next adjacent core elements 40 are spatially separated when drive shaft 10 is disposed in straight as it is shown in FIG. 1. This configuration insures that core elements 40 are fully nested by action of compression spring 30 thereby insuring that axial deviation between next adjacent core elements 40 does not exceed intended design limitation, such as a preferred limitation of about five degrees herein suggested when drove shaft 10 is flexed as shown in FIG. 2.

Core element 40' differs from core elements 40 in the particular that the base portion 42' of shank portion 41 is sized to be received in end socket portion 18 of driven element 11.

The provision of spring loading elements in nested joinder at all times during use serves to prevent excessive angular deviation between elements from occurring and resulting in failure of the drive shaft to perform satisfactorily for its intended use.

I claim:

1. A flexible transmission shaft comprising a series of adjacent core elements, each core element including:

a. a socket portion with a socket defined therein, and b. a shank portion extending from the socket portion, wherein the shank portion expands in diameter as it extends from the socket portion;

wherein:

(1) each core element has its shank portion interfit in the socket of the socket portion of the next core element in the series, wherein the shank portion of each core element is circumferentially surrounded by the socket portion of the next core element in the series; and (2) the shank portions and sockets are faceted to prevent relative rotation between each shank portion and the socket in which it is fit.

2. The flexible transmission shaft of claim 1 wherein the shank portion extends from the side of the socket portion opposite the socket.

3. The flexible transmission shaft of claim 1 wherein the shank portion first expands in diameter as it extends from the socket portion, and then reduces in diameter.

4. The flexible transmission shaft of claim 1 wherein the shank portion has an outer circumference spaced inwardly from the outer circumference of the socket portion.

5. The flexible transmission shaft of claim 1 wherein the shank portions and sockets are polygonally faceted.

6. The flexible transmission shaft of claim 1 wherein the socket portion decreases in diameter as it extends from the shank portion.

7. The flexible transmission shaft of claim 1 wherein the shank portion of each core element is at least partially complementarily interfit within the socket of the socket portion of the next core element in the series.

8. The flexible transmission shaft of claim 1 wherein the length of each shank portion is greater than the depth of the socket in which it is fit, whereby the shank portion at least partially extends from the socket when the shank portion is fully inserted therein.

9. The flexible transmission shaft of claim 1 wherein the socket portion and shank portion of each element are coaxially aligned about the axis of the socket.

10. A flexible transmission shaft comprising a series of core elements adjacently interfit along a flexible axis, wherein each core element includes:

a. a socket portion with a socket defined therein, the socket having an internal polygonal cross-sectional area, and b. a shank portion extending from the socket portion, the shank portion including:

(1) a shank portion head spaced from the socket portion, the shank portion head having a polygonal cross-sectional area complementarily interfit within a portion of the socket of the next core element in the series; and (2) a shank portion juncture between the shank portion head and the socket portion, the shank portion juncture narrowing in cross-sectional area between the shank portion head and the socket portion.

11. The flexible transmission shaft of claim 10 wherein the socket portion, shank portion head, and shank portion juncture of each element are coaxially aligned about the axis of the socket.

12. The flexible transmission shaft of claim 10 wherein at least a portion of the shank portion juncture of each element protrudes from the socket of the next core element in the series when the shank portion head of the element is interfit within the socket of such next core element.

13. The flexible transmission shaft of claim 10 wherein the shank portion head of each element is circumferentially surrounded by the socket portion of the next core element in the series when interfit within the socket of such next core element.

14. The flexible transmission shaft of claim 10 wherein the shank portion extends from the side of the socket portion opposite the socket.

15. The flexible transmission shaft of claim 10 wherein the shank portion has an outer circumference spaced inwardly from the outer circumference of the socket portion.

16. The flexible transmission shaft of claim 15 wherein the shank portion juncture has an outer circumference spaced inwardly from the outer circumference of the shank portion head.

17. The flexible transmission shaft of claim 10 wherein the socket portion decreases in diameter as it extends from the shank portion.

18. A flexible transmission shaft comprising core elements adjacently interfit along a flexible axis, each core element including:

a. a socket portion with a socket defined therein, the socket having a mouth;

b. a shank portion extending from the socket portion, the shank portion including:

(1) a shank portion juncture extending from the socket portion, the shank portion juncture having an outer circumference spaced inwardly from the outer circumference of the socket portion;

(2) a shank portion head extending from the shank portion juncture, the shank portion head having a polygonal outer circumference spaced outwardly from the outer circumference of the shank portion juncture;

wherein the socket non-rotatably receives the shank portion of one of the adjacent core elements therein.

19. The flexible transmission shaft of claim 18 wherein the shank portion non-rotatably received within the socket is at least partially complementarily fit within the socket.

20. The flexible transmission shaft of claim 19 wherein the socket has a polygonal inner circumference.

21. The flexible transmission shaft of claim 18 wherein the shank portion non-rotatably received within the socket is circumferentially surrounded by the socket portion.

22. The flexible transmission shaft of claim 18 wherein the socket portion increases in diameter as it extends from the mouth of the socket.

23. The flexible transmission shaft of claim 18 wherein the shank portion extends from the side of the socket portion opposite the socket.

24. The flexible transmission shaft of claim 18 wherein the shank portion head has an outer circumference spaced inwardly from the outer circumference of the socket portion.

25. The flexible transmission shaft of claim 18 wherein the length of each shank portion is greater than the depth of the socket in which it is fit, whereby at least a portion of the shank portion juncture protrudes from the socket when the shank portion is fully inserted therein.

26. The flexible transmission shaft of claim 18 wherein the socket portion, shank portion head, and shank portion juncture of each element are coaxially aligned about the axis of the socket.

27. A flexible transmission shaft comprising a series of adjacent core elements, each core element including:

a. a socket portion with a socket defined therein, and b. a shank portion extending from the socket portion, wherein the shank portion first expands in diameter as it extends from the socket portion, and then reduces in diameter;

wherein:

(1) each core element has its shank portion interfit in the socket of the socket portion of the next core element in the series; and (2) the shank portions and sockets are faceted to prevent relative rotation between each shank portion and the socket in which it is fit.

28. The flexible transmission shaft of claim 27 wherein the shank portion has an outer circumference spaced inwardly from the outer circumference of the socket portion.

29. The flexible transmission shaft of claim 27 wherein the shank portions and sockets are polygonally faceted.

30. The flexible transmission shaft of claim 27 wherein the socket portion decreases in diameter as it extends from the shank portion.

31. The flexible transmission shaft of claim 27 wherein the shank portion of each core element is at least partially complementarily interfit within the socket of the socket portion of the next core element in the series.

32. The flexible transmission shaft of claim 27 wherein the length of each shank portion is greater than the depth of the socket in which it is fit, whereby the shank portion at least partially extends from the socket when the shank portion is fully inserted therein.

33. The flexible transmission shaft of claim 27 wherein the socket portion and shank portion of each element are coaxially aligned about the axis of the socket.

34. A flexible transmission shaft comprising a series of adjacent core elements, each core element including:

a. a socket portion with a socket defined therein, and b. a shank portion extending from the socket portion, wherein the shank portion expands in diameter as it extends from the socket portion;

wherein:

(1) each core element has its shank portion interfit in the socket of the socket portion of the next core element in the series;

(2) the socket portion and shank portion of each element are coaxially aligned about the axis of the socket; and (3) the shank portions and sockets are faceted to prevent relative rotation between each shank portion and the socket in which it is fit.

35. The flexible transmission shaft of claim 34 wherein the shank portion first expands in diameter as it extends from the socket portion, and then reduces in diameter.

36. The flexible transmission shaft of claim 34 wherein the shank portion has an outer circumference spaced inwardly from the outer circumference of the socket portion.

37. The flexible transmission shaft of claim 34 the shank portions and sockets are polygonally faceted.

38. The flexible transmission shaft of claim 34 wherein the socket portion decreases in diameter as it extends from the shank portion.

39. The flexible transmission shaft of claim 34 wherein the shank portion of each core element is at least partially complementarily interfit within the socket of the socket portion of the next core element in the series.

40. The flexible transmission shaft of claim 34 wherein the length of each shank portion is greater than the depth of the socket in which it is fit, whereby the shank portion at least partially extends from the socket when the shank portion is fully inserted therein.

* * * * *